US011739947B2

(12) United States Patent
Paller et al.

(10) Patent No.: US 11,739,947 B2
(45) Date of Patent: Aug. 29, 2023

(54) OVEN APPLIANCE WITH CONVECTION BAKE AND BROIL

(71) Applicant: Haier US Appliance Solutions, Inc., Wilmington, DE (US)

(72) Inventors: Hans Juergen Paller, Louisville, KY (US); Rebekah Leigh Tyler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 286 days.

(21) Appl. No.: 17/096,680

(22) Filed: Nov. 12, 2020

(65) Prior Publication Data

US 2022/0146117 A1 May 12, 2022

(51) Int. Cl.

| | |
|---|---|
| ***F24C 15/32*** | (2006.01) |
| ***F24C 11/00*** | (2006.01) |
| ***F24C 15/00*** | (2006.01) |
| ***F24C 3/08*** | (2006.01) |

(52) U.S. Cl.

CPC ..... *F24C 15/325* (2013.01); *F24C 3/08* (2013.01); *F24C 11/00* (2013.01); *F24C 15/002* (2013.01)

(58) Field of Classification Search

CPC ..... F24C 11/00; F24C 15/002; F24C 15/325; F24C 3/08

USPC ..... 126/21 A

See application file for complete search history.

(56) References Cited

U.S. PATENT DOCUMENTS

| | | | | |
|---|---|---|---|---|
| 3,782,360 | A * | 1/1974 | Brucken | F24C 15/02 126/273 R |
| 4,430,541 | A | 2/1984 | Day, Jr. | |
| 4,830,489 | A | 5/1989 | Cain et al. | |
| 4,926,837 | A * | 5/1990 | Parker | F24C 3/128 219/400 |
| 4,930,489 | A | 6/1990 | McFadden | |
| 5,203,315 | A | 4/1993 | Clawson | |
| 7,422,009 | B2 | 9/2008 | Rummel et al. | |
| 10,302,309 | B2 | 5/2019 | Paller | |
| 2020/0072475 | A1* | 3/2020 | Crow | F24C 15/322 |

FOREIGN PATENT DOCUMENTS

| | | | |
|---|---|---|---|
| FR | 2615359 | A1 | 11/1988 |
| GB | 381564 | A | 10/1932 |

* cited by examiner

*Primary Examiner* — Vivek K Shirsat
(74) *Attorney, Agent, or Firm* — Dority & Manning, P.A.

(57) ABSTRACT

An oven appliance includes a cabinet with a chamber is defined within the cabinet for receipt of food items for cooking. The oven appliance also includes a gas burner positioned proximate to a bottom portion and/or a back wall of the chamber. A natural convection flow path is defined through the chamber. The natural convection flow path extends from an origin at the gas burner to a top wall of the chamber. The oven appliance further includes a convection fan positioned along the natural convection flow path above the gas burner and below the top wall. The convection fan is positioned and configured to divert combustion products generated by the gas burner from the natural convection flow path along a forced convection flow path towards a center of the chamber when the convection fan is activated.

17 Claims, 7 Drawing Sheets

OVEN APPLIANCE WITH CONVECTION BAKE AND BROIL

FIELD OF THE INVENTION

The subject matter of the present disclosure relates generally to an oven appliance, such as an oven appliance which provides convection heating for both bake and broil operations from the same heating element.

BACKGROUND OF THE INVENTION

Oven appliances generally include a cabinet that defines a cooking chamber for cooking food items therein, such as by baking or broiling the food items. To heat the cooking chamber for cooking, oven appliances include one or more heating elements positioned at a top portion, a bottom portion, or both the top portion and the bottom portion of the cooking chamber. Some oven appliances also include a convection heating element and fan for convection cooking cycles. The heating element or elements may be used for various cycles of the oven appliance, such as a preheat cycle, a cooking cycle, or a self-cleaning cycle.

Conventional oven appliances that provide multiple cooking operations or functions typically include multiple heating elements, with at least one heating element being dedicated or specialized for each cooking function. For example, cooking appliances which are configured for both radiant heating and convective heating typically include at least one heating element for each function which is separate from the heating element(s) used in every other function and is dedicated to only the one function. Similar arrangements are also provided for baking and/or broiling, e.g., each function uses a specific, dedicated single-purpose heating element.

Although such configurations can provide flexibility and versatility in oven operations, the use of multiple independent heating elements also results in an increase in cost and complexity of the associated oven appliance.

Accordingly, an oven appliance with features for providing multiple functions, such as convection heating and radiant heating, or baking and broiling, in various combinations, from a single multi-purpose heating element would be desirable.

BRIEF DESCRIPTION OF THE INVENTION

Aspects and advantages of the invention will be set forth in part in the following description, may be apparent from the description, or may be learned through practice of the invention.

In one exemplary embodiment, an oven appliance is provided. The oven appliance includes a cabinet defining a vertical direction, a lateral direction, and a transverse direction. The vertical, lateral, and transverse directions are mutually perpendicular. The cabinet includes a front portion spaced apart from a back portion along the transverse direction and a left side spaced apart from a right side along the lateral direction. A chamber is defined within the cabinet for receipt of food items for cooking. The oven appliance also includes a gas burner positioned proximate to a bottom portion of the chamber. A natural convection flow path is defined through the chamber. The natural convection flow path extends from an origin at the gas burner to a top wall of the chamber. The oven appliance further includes a convection fan positioned along the natural convection flow path above the gas burner and below the top wall. The convection fan is positioned and configured to divert combustion products generated by the gas burner from the natural convection flow path along a forced convection flow path towards a center of the chamber when the convection fan is activated.

In another exemplary embodiment, an oven appliance is provided. The oven appliance includes a cabinet defining a vertical direction, a lateral direction, and a transverse direction. The vertical, lateral, and transverse directions are mutually perpendicular. The cabinet includes a front portion spaced apart from a back portion along the transverse direction and a left side spaced apart from a right side along the lateral direction. A chamber is defined within the cabinet for receipt of food items for cooking. The oven appliance also includes a gas burner positioned proximate to a back wall of the chamber. A natural convection flow path is defined through the chamber. The natural convection flow path extends from an origin at the gas burner to a top wall of the chamber. The oven appliance further includes a convection fan positioned along the natural convection flow path above the gas burner and below the top wall. The convection fan is positioned and configured to divert combustion products generated by the gas burner from the natural convection flow path along a forced convection flow path towards a center of the chamber when the convection fan is activated.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
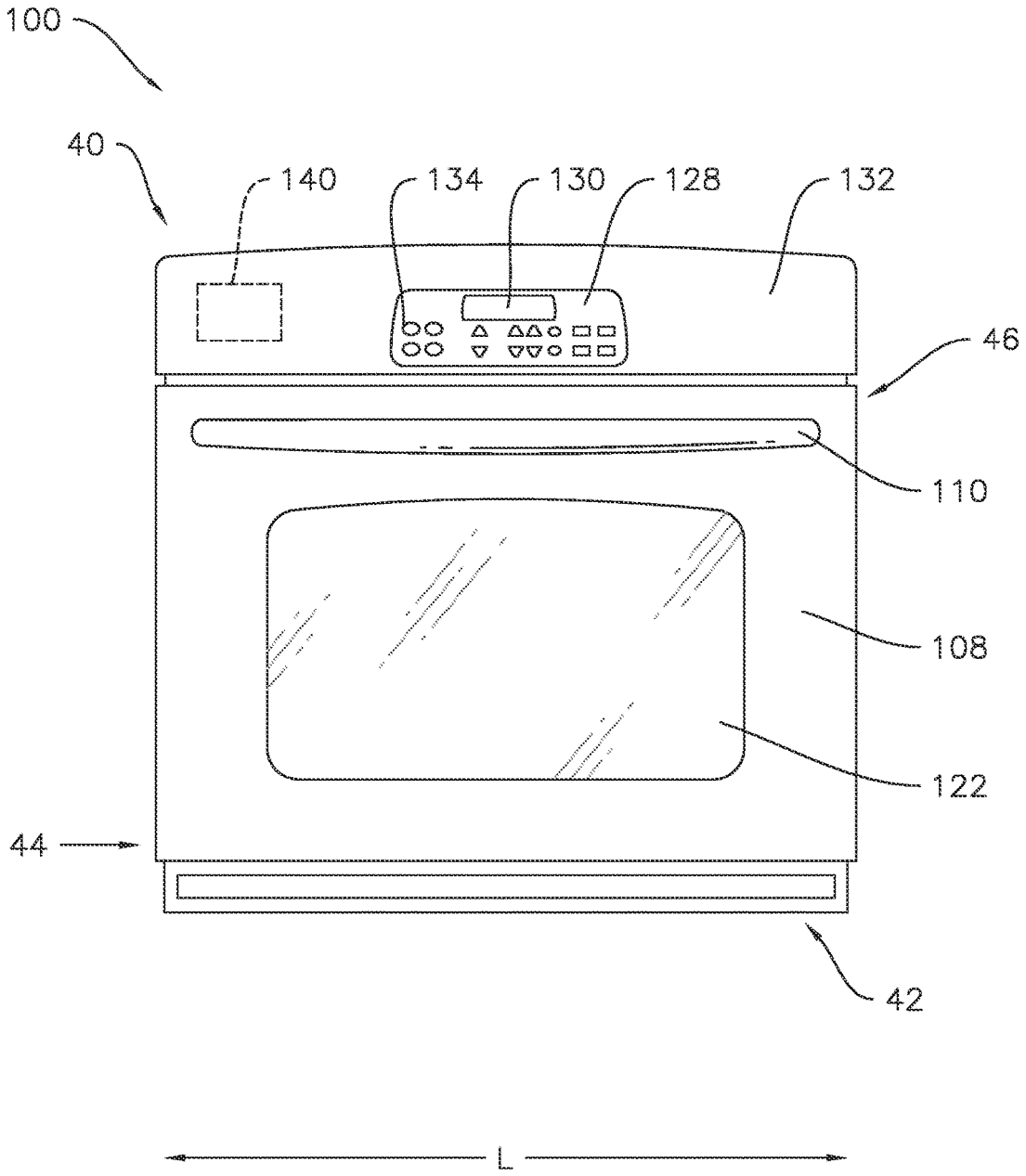
FIG. 1 provides a front view of an exemplary oven appliance according to one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. In the context of an angle or direction, such terms include values within ten degrees greater or less than the stated direction. For example, "generally vertical" includes directions within ten degrees of vertical in any direction, e.g., clockwise or counter-clockwise.

FIGS. 1 through 4 illustrate an oven appliance 100 according to an exemplary embodiment of the present subject matter. Oven appliance 100 includes an insulated cabinet 102 which defines a vertical direction V, a lateral direction L, and a transverse direction T. The vertical, lateral, and transverse directions V, L, and T are mutually perpendicular and form an orthogonal direction system. Cabinet 102 extends between a top portion 40 and a bottom portion 42 along the vertical direction V. Cabinet 102 extends between a left side 44 and a right side 46 along the lateral direction L and between a front portion 48 and a back portion 50 along the transverse direction T.

Still referring to FIGS. 1 through 4, in various exemplary embodiments, oven appliance 100 includes an insulated cabinet 102 with an interior cooking chamber 104 defined by a top wall 112, a bottom wall 114, a back wall 116, and a pair of opposing side walls 118. Cooking chamber 104 is configured for the receipt of one or more food items to be cooked. Oven appliance 100 includes a door 108 pivotally mounted to cabinet 102 at the opening 106 of cabinet 102 to permit selective access to cooking chamber 104 through opening 106. A handle 110 is mounted to door 108 and assists a user with opening and closing door 108. For example, a user can pull on handle 110 to open or close door 108 and access cooking chamber 104.

Oven appliance 100 can include a seal (not shown) between door 108 and cabinet 102 that assists with maintaining heat and cooking vapors within cooking chamber 104 when door 108 is closed as shown in FIGS. 1 through 4. Multiple parallel glass panes 122 provide for viewing the contents of cooking chamber 104 when door 108 is closed and assist with insulating cooking chamber 104. A baking rack 142 is positioned in cooking chamber 104 for the receipt of food items or utensils containing food items. Baking rack 142 is slidably received onto embossed ribs or sliding rails 144 such that rack 142 may be conveniently moved into and out of cooking chamber 104 when door 108 is open.

Figure 2:
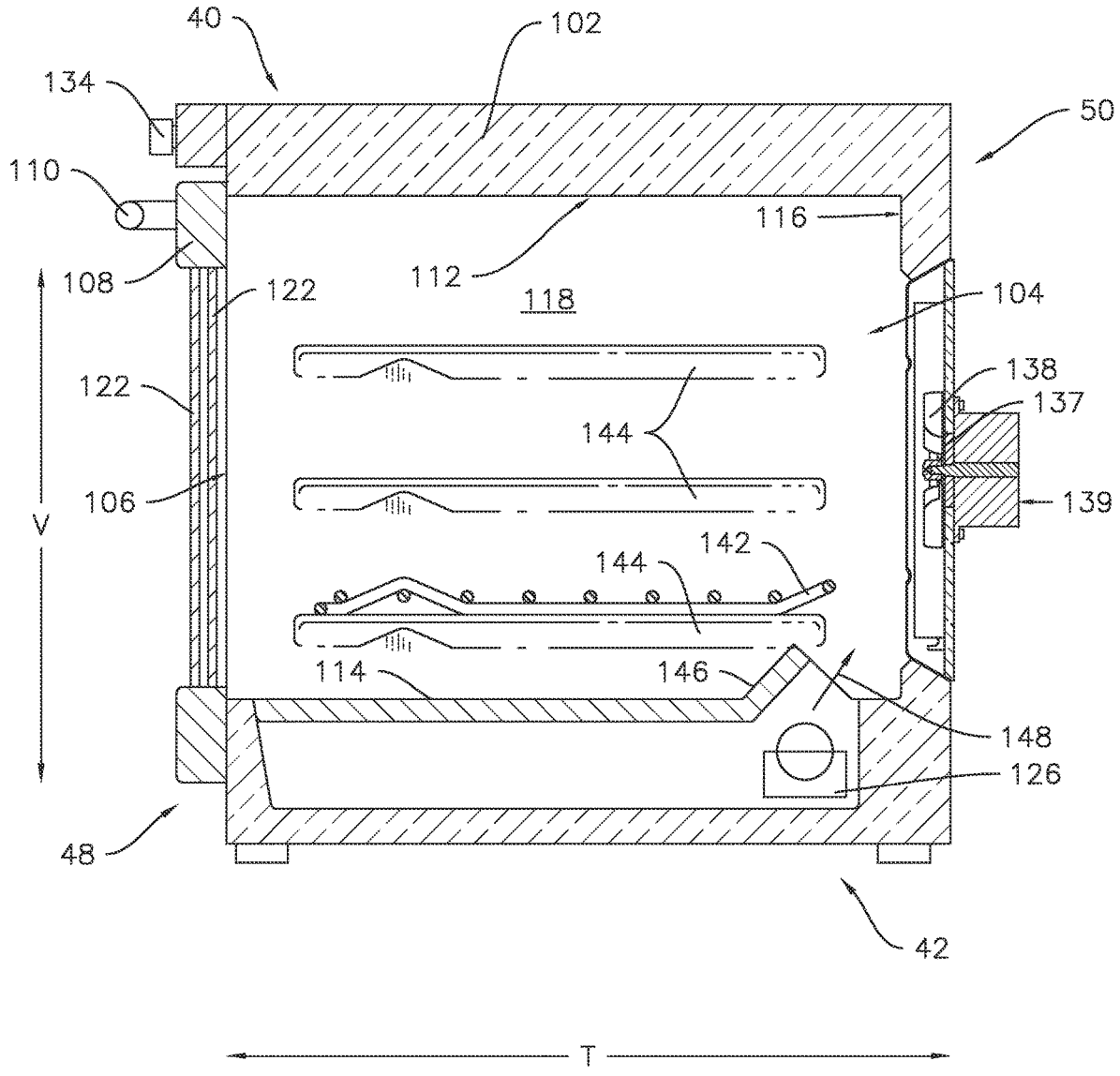
FIG. 2 is a cross-sectional view of the oven appliance of FIG. 1 according to one or more embodiments of the present subject matter.
Figure 3:
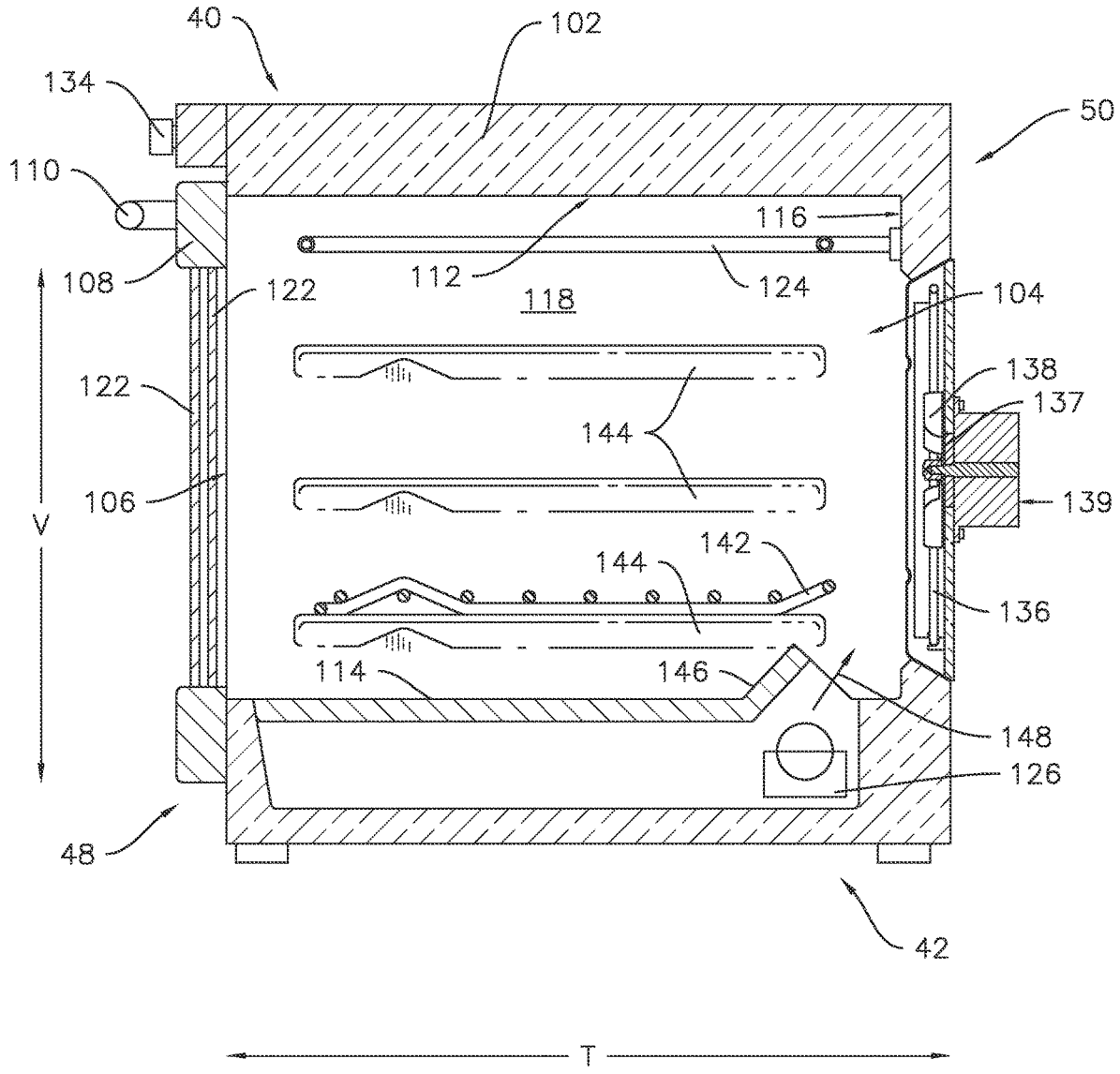
FIG. 3 provides a cross-sectional view of the oven appliance of FIG. 1 according to one or more additional embodiments of the present subject matter.
Figure 4:
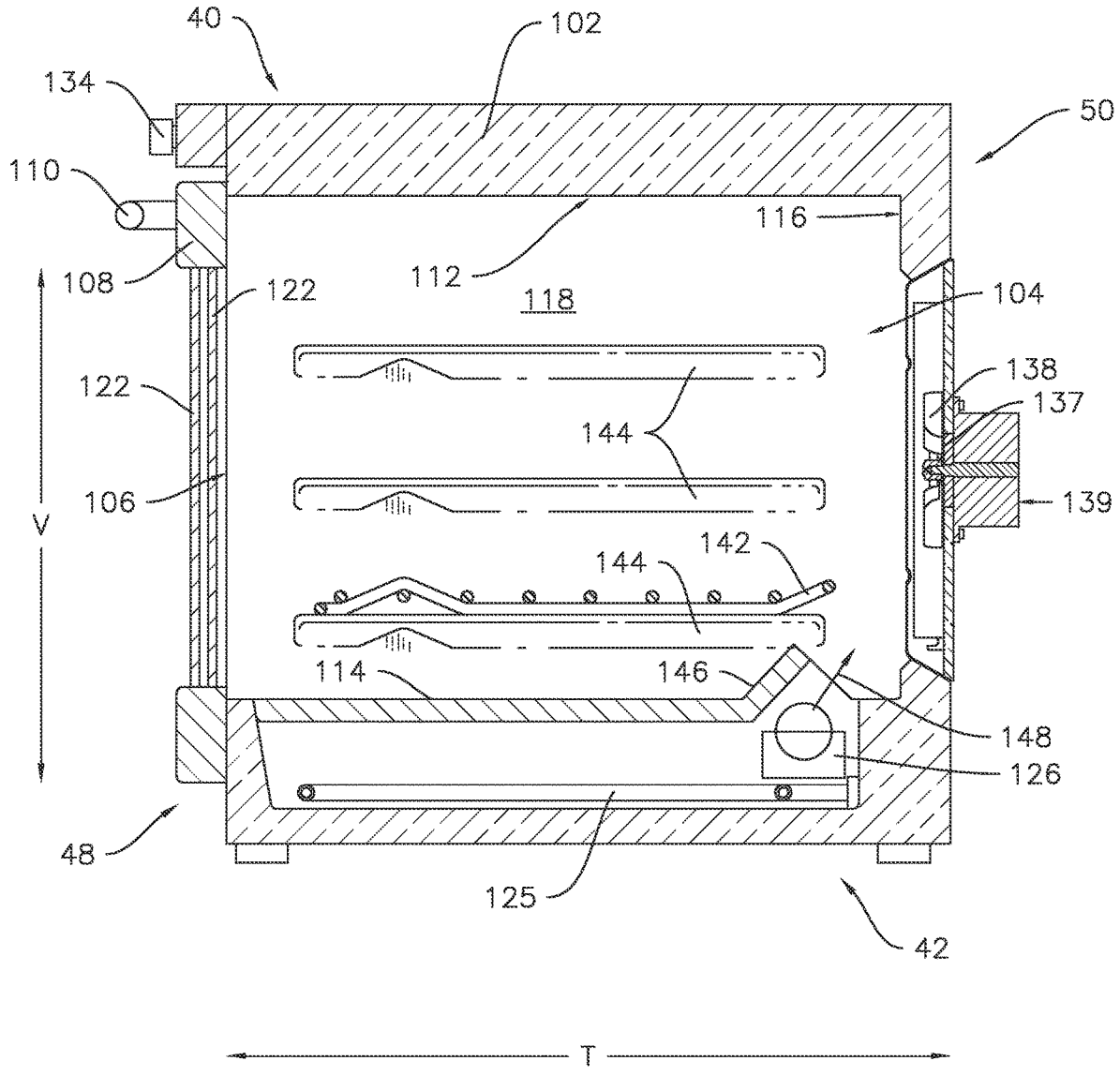
FIG. 4 provides a cross-sectional view of the oven appliance of FIG. 1 according to one or more further additional embodiments of the present subject matter.

One or more heating elements may be included at the top, bottom, or both of cooking chamber 104 to provide heat to cooking chamber 104 for cooking. Such heating element(s) can be gas, electric, microwave, or a combination thereof. For example, in the embodiment shown in FIG. 2, oven appliance 100 includes a bottom heating element 126, where bottom heating element 126 is positioned adjacent to and below bottom wall 114 and adjacent to and in front of back wall 116. In particular, the bottom heating element 126 in the embodiment illustrated in FIG. 2 is a gas burner. In additional embodiments, e.g., as illustrated in FIG. 3, the oven appliance 100 may also a top heating element 124 in addition to the bottom heating element 126, where the top heating element 124 may be, e.g., a resistance heating element 124 as illustrated in FIG. 3. As illustrated in FIG. 4, in other example embodiments the oven appliance 100 may include a second bottom heating element 125, such as the bottom electric heating element 125 illustrated in FIG. 4.

In the illustrated example embodiments, oven appliance 100 also has a convection fan 138 positioned adjacent back wall 116 of cooking chamber 104. In some embodiments, e.g., as illustrated in FIG. 3, a convection heating element 136 may also be provided, e.g., at and/or proximate to, such as encircling around, the convection fan 138. Convection fan 138 is powered by a convection fan motor 139. Further, convection fan 138 can be a variable speed fan—meaning the speed of fan 138 may be controlled or set anywhere between and including, e.g., zero and one hundred percent (0%-100%). In certain embodiments, oven appliance 100 may also include a bidirectional triode thyristor (not shown), i.e., a triode for alternating current (TRIAC), to regulate the operation of convection fan 138 such that the speed of fan 138 may be adjusted during operation of oven appliance 100. The speed of convection fan 138 can be determined by controller 140. In addition, a sensor 137 such as, e.g., a rotary encoder, a Hall effect sensor, or the like, may be included at the base of fan 138, for example, between fan 138 and motor 139 as shown in the exemplary embodiment of FIGS. 2 and 3, to sense the speed of fan 138. The speed of fan 138 may be measured in, e.g., revolutions per minute ("RPM"). In some embodiments, the convection fan 138 may be configured to rotate in two directions, e.g., a first direction of rotation and a second direction of rotation opposing the first direction of rotation. For example, in some embodiments, reversing the direction of rotation, e.g., from the first direction to the second direction or vice versa, may still direct air from the back of the cavity. As another example, in some embodiments reversing the direction results in air being directed from the top and/or sides of the cavity rather than the back of the cavity. Additionally, the convection heating features are optional and are shown and described herein solely by way of example. In other embodiments the oven appliance 100 may include different convection heating features or may not include the convection heating element 136 at all (e.g., as illustrated in FIGS. 2 and 4).

In various embodiments, more than one convection heater, e.g., more than one convection heating elements 136 and/or convection fans 138, may be provided. In such embodiments, the number of convection fans and convection heaters may be the same or may differ, e.g., more than one convection heating element 136 may be associated with a single convection fan 138. Similarly, more than one top heating element 124 and/or more than one bottom heating element 126 may be provided in various combinations, e.g., one top heating element 124 with two or more bottom heating elements 126, two or more bottom heating elements 126 with no top heating element 124, two or more top heating elements 124 with no bottom heating element 126, etc.

Oven appliance 100 includes a user interface 128 having a display 130 positioned on an interface panel 132 and having a variety of controls 134. Interface 128 allows the user to select various options for the operation of oven 100 including, e.g., various cooking and cleaning cycles. Operation of oven appliance 100 can be regulated by a controller 140 that is operatively coupled to, i.e., in communication with, user interface 128, heating elements 124, 126, and other components of oven 100 as will be further described.

For example, in response to user manipulation of the user interface 128, controller 140 can operate the heating element(s). Controller 140 can receive measurements from one or more temperature sensors (not shown) which are in or in thermal communication with the cooking chamber 104. Controller 140 may also provide information such as a status indicator, e.g., a temperature indication, to the user with display 130. Controller 140 can also be provided with other features as will be further described herein.

Controller 140 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor. The memory can store information accessible by the processor(s), including instructions that can be executed by processor(s). For example, the instructions can be software or any set of instructions that when executed by the processor(s), cause the processor(s) to perform operations. For the embodiment depicted, the instructions may include a software package configured to operate the system, e.g., to execute exemplary methods of operating the oven appliance 100. Controller 140 may also be or include the capabilities of either a proportional (P), proportional-integral (PI), or proportional-integral-derivative (PID) control for feedback-based control implemented with, e.g., temperature feedback from one or more sensors such as temperature sensors and/or probes, etc.

Controller 140 may be positioned in a variety of locations throughout oven appliance 100. In the illustrated embodiment, controller 140 is located next to user interface 128 within interface panel 132. In other embodiments, controller 140 may be located under or next to the user interface 128, otherwise within interface panel 132, or at any other appropriate location with respect to oven appliance 100. Generally, controller 140 will be positioned within the cabinet 102. In the embodiment illustrated in FIG. 1, input/output ("I/O") signals are routed between controller 140 and various operational components of oven appliance 100 such as heating elements 124, 126, 136, convection fan 138, controls 134, display 130, alarms, and/or other components as may be provided. In one embodiment, user interface 128 may represent a general purpose I/O ("GPIO") device or functional block.

Although shown with touch type controls 134, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads. User interface 128 may include other display components, such as a digital or analog display device designed to provide operational feedback to a user. User interface 128 may be in communication with controller 140 via one or more signal lines or shared communication busses.

While oven 100 is shown as a wall oven, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the controls 134, as mentioned above, are possible. As another example, the oven appliance 100 may include multiple doors 108 instead of or in addition to the single door 108 illustrated. Such examples include a dual cavity oven, a French door oven, and others. As still another example, one or more of the illustrated electrical resistance heating elements may be substituted with gas burners or microwave heating elements, or any other suitable heating elements. The examples described herein are provided by way of illustration only and without limitation.

As shown in FIGS. 2 through 4, the gas burner 126 may be positioned proximate to a bottom portion of the chamber 104, e.g., outside of the chamber 104 but within the cabinet 102 and positioned most proximate to the bottom wall 114 of the chamber 104. Thus, the gas burner 126 may be in thermal communication and in fluid communication with the chamber 104 through the bottom wall 114, such as through a hood 146 defined in the bottom wall 114. The hood 146 may have an open end positioned and oriented to direct combustion products (e.g., flames and hot gases) 148 from the gas burner 126 into the chamber. More particularly, the gas burner 126 may be in direct fluid communication with the chamber 104 through the hood 146 of the bottom wall 114, e.g., where combustion products 148 from the gas burner 126 are oriented directly into the chamber 104 through the hood 146 and not against any intermediate solid structure, such as a solid portion of the bottom wall 114 or a flame spreader. Thus, the combustion products 148 may follow a direct flow path, e.g., a path that extends along a straight line, unobstructed and uninterrupted by any solid components of the oven appliance 100, from the gas burner 126 to the cooking chamber 104 through the hood 146, as illustrated in FIGS. 2 through 4. The gas burner 126 may also be positioned at a rear portion of the chamber 104, such as most proximate to the back wall 116 of the chamber 104. Moreover, the hood 146 may be oriented generally upward, e.g., towards the top wall 112 of the chamber 104, along the vertical direction V, whereby the combustion products 148 flow by natural convection (e.g., heat rising) from the gas burner 126 into the chamber 104 through the hood 146. The gas burner 126 may also be oriented such that the gas burner 126, e.g., a longitudinal axis thereof, extends along the lateral direction L generally parallel to the back wall 116 of the chamber 104.

Figure 5:
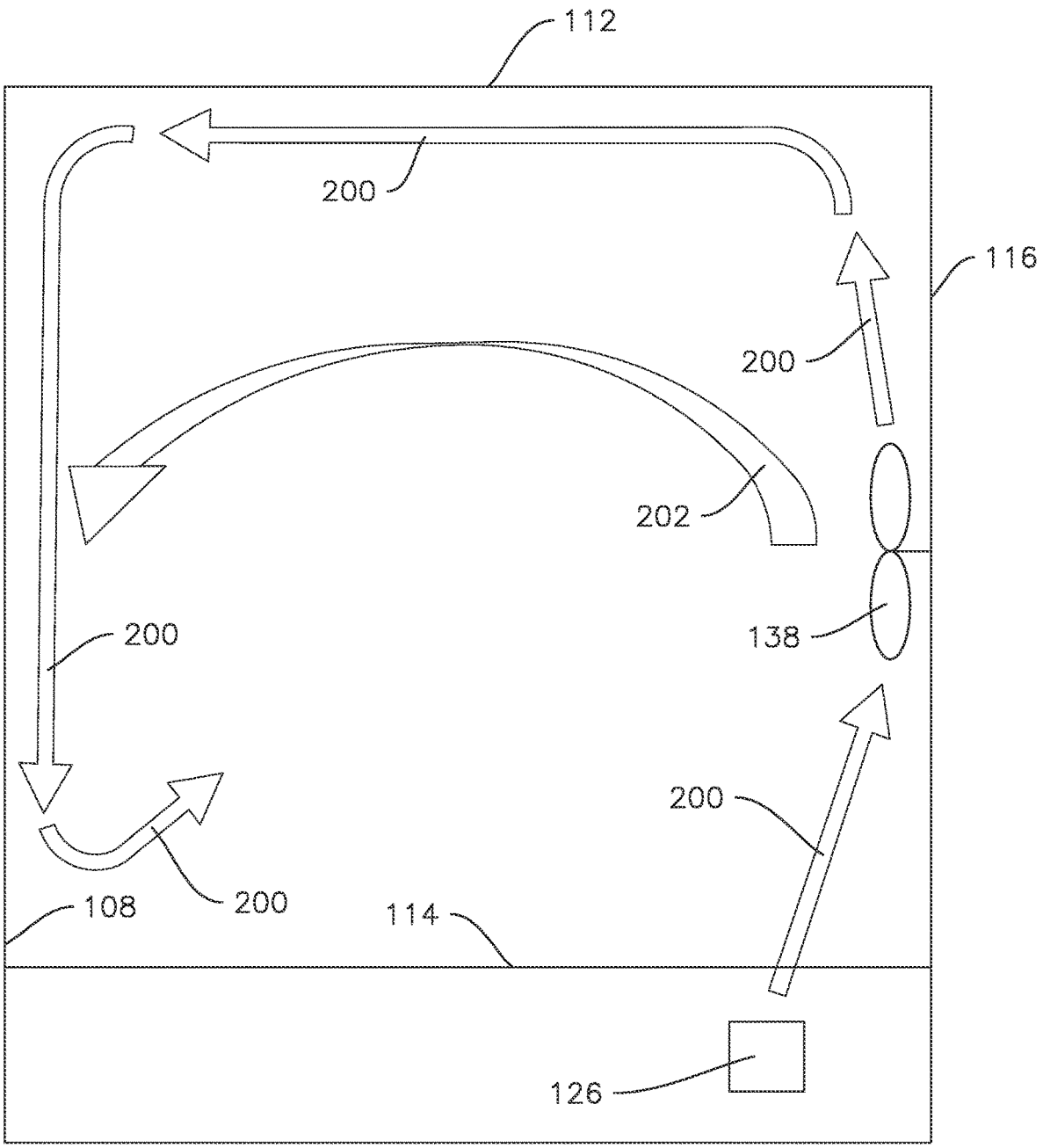
FIG. 5 provides a schematic view of flow paths for hot gases within the oven appliance of FIG. 2.

As shown in FIGS. 2 and 5, in some embodiments, the gas burner 126 may be the only combustive heat source (e.g., there are no other gas burners but the one) for the chamber, and, in further embodiments, the gas burner 126 may also be the only heat source for the chamber 104. The term "heat source" is intended to mean a source of direct heating of the chamber 104, such as a heating element in direct thermal communication with the chamber 104, e.g., which is oriented into or towards the chamber 104 without any intermediate thermally insulating structures. For example, such embodiments may also include ambient heat sources which are separated from the chamber 104 by at least a portion of the insulation of the insulated cabinet 102 and/or the door 108, including the windows 122 of the door 108. Such ambient heat sources may include, e.g., one or more burners on a cooktop of the oven appliance 100 in embodiments where the oven appliance 100 is a range appliance including a cooktop. Those of ordinary skill in the art will recognize that such cooktop elements would be positioned above the chamber 104 and oriented away from the chamber 104, such that the cooktop heating elements would not be considered as heat sources for the chamber 104 because such elements are separated from the chamber 104 by insulation and/or are not oriented towards or into the chamber 104.

Still with reference to FIGS. 2 and 5, in embodiments where the gas burner 126 is the only combustive heat source for the chamber 104 and the only heat source for the chamber 104, combustion products 148 (FIG. 2) from the gas burner 126 may follow a natural convection flow path 200 (FIG. 5) within and through the chamber 104. As mentioned above, the natural convection flow path 200 may be partially defined by the positioning and orientation of the gas burner 126 and the hood 146, relative to each other and the chamber 104, such that the natural convection flow path 200 begins at the gas burner 126 and/or the hood 146. The hood 146 may be obliquely oriented and may thus be configured to direct the combustion products 148 up and back, e.g., to the back wall 116 and towards the top wall 112. Thus, the natural convection flow path 200 may be collectively defined by the hood 146, the back wall 116, the top wall 112, and at least partially defined by the door 108, as illustrated in FIG. 5.

More specifically, as illustrated in FIG. 5, the natural convection flow path 200 may, in some embodiments, extend from the gas burner 126, upward along the vertical direction V across the back wall 116 of the chamber 104, and forward along the transverse direction T across the top wall 112 of the chamber 104. As the combustion products 148 travel across the top wall 112, they may pass over and in close proximity to food items for broiling said food items. For example, such food items may be positioned on the rack 142 and the rack 142 may be placed on the uppermost rail 144 whereby the food items may absorb thermal energy from the combustion products 148 as the combustion products 148 travel forward across the top wall 112, such as across all or approximately the entire transverse length of the top wall 112. Also as illustrated in FIG. 5, the natural convection flow path 200 may then be directed downwards after reaching the end of the top wall 112, such as by encountering the door 108, as shown. Thus, the combustion products 148 may circulate throughout an entire perimeter of the chamber 104, or at least approximately all of each of three sides thereof, e.g., the sides of the chamber 104 defined by the back wall 116, the top wall 112, and the door 108.

As may be seen, e.g., in FIGS. 2 and 5, the convection fan 138 may be positioned along the natural convection flow path 200 above the gas burner 126 and below the top wall 112. Thus, the convection fan 138 may be positioned and configured to divert the combustion products 148 generated by the gas burner 126 from the natural convection flow path 200. For example, when the convection fan 138 is positioned as illustrated in FIGS. 2 and 5, the convection fan 138 may urge the combustion products 148 along a forced convection flow path 202 towards a center of the chamber 104 when the convection fan 138 is activated. In such embodiments, the convection fan 138 may thereby be usable in a bake mode, where the combustion products 148 diverted from the natural convection flow path 200 by the convection fan 138 may be used to heat, e.g., food items positioned in the middle and/or bottom portions of the cooking chamber 104, such as on rack(s) 142 on the middle or bottom rail(s) 144. Thus, the gas burner 126 may thereby provide heat for both broiling (when the convection fan 138 is not activated such that the combustion products 148 follow the natural convection flow path 200) and for baking (when the convection fan 138 is activated such that the combustion products 148 are diverted from the natural convection flow path 200 and onto the forced convection flow path 202).

Figure 6:
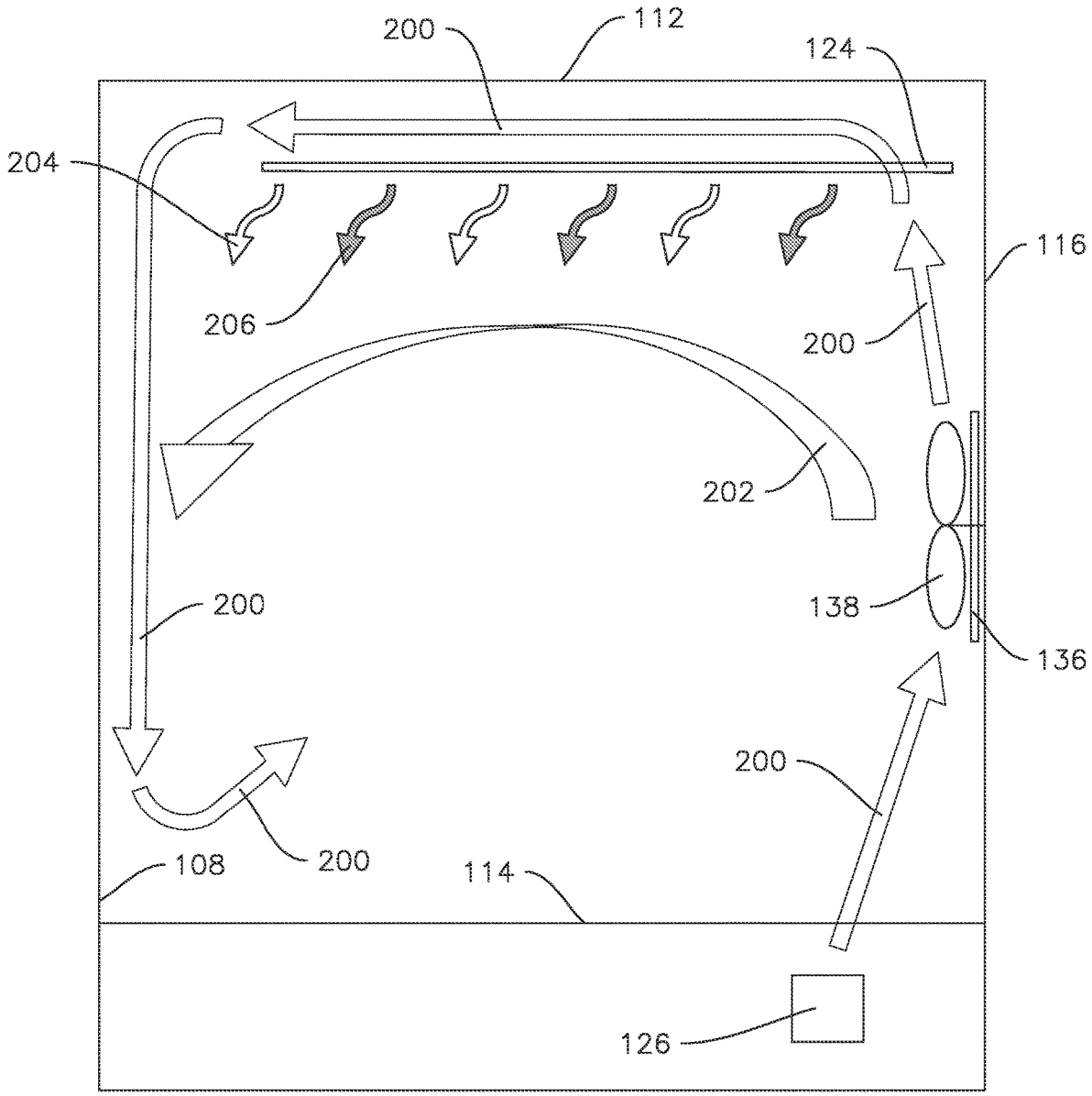
FIG. 6 provides a schematic view of flow paths for hot gases within the oven appliance of FIG. 3.

As shown in FIGS. 3 and 6, in some embodiments, the oven appliance 100 may also include one or more electric resistance heating elements, such as the top element 124 and the convection element 136. In such embodiments, where the additional heating elements are electric resistance heating elements, the gas burner 126 is not the only heat source for the chamber, but may be the only combustive heat source for the chamber 104. In such embodiments, the broil operation may be similar to that described above with respect to FIGS. 2 and 5, where food items in the cooking chamber 104 may receive convection heat (illustrated by white arrows 204 in FIG. 6) from the combustion products 148 travelling along the natural convection flow path 200 as described above. Additionally, when the upper heating element 124 is provided, such food items may also receive radiant heat (illustrated by shaded arrows 206 in FIG. 6) from the upper heating element 124 during the broil operation.

In embodiments where the convection heating element 136 is provided, e.g., as illustrated in FIGS. 3 and 6, the bake operation may be similar to the bake operation described above with respect to FIGS. 2 and 5, e.g., in that the convection fan 138 is activated to divert the combustion products 148 from the natural convection flow path 200 and direct the combustion products 148 towards the center of the chamber 104 as described above. Further, in embodiments including the convection heating element 136, the bake operation may also include activating the convection heating element 136 when the convection fan 138 is activated, such that thermal energy from (generated by) the electric resistance convection heating element 136 is also directed along the forced convection path 202 along with the combustion products from the gas burner 126.

Figure 7:
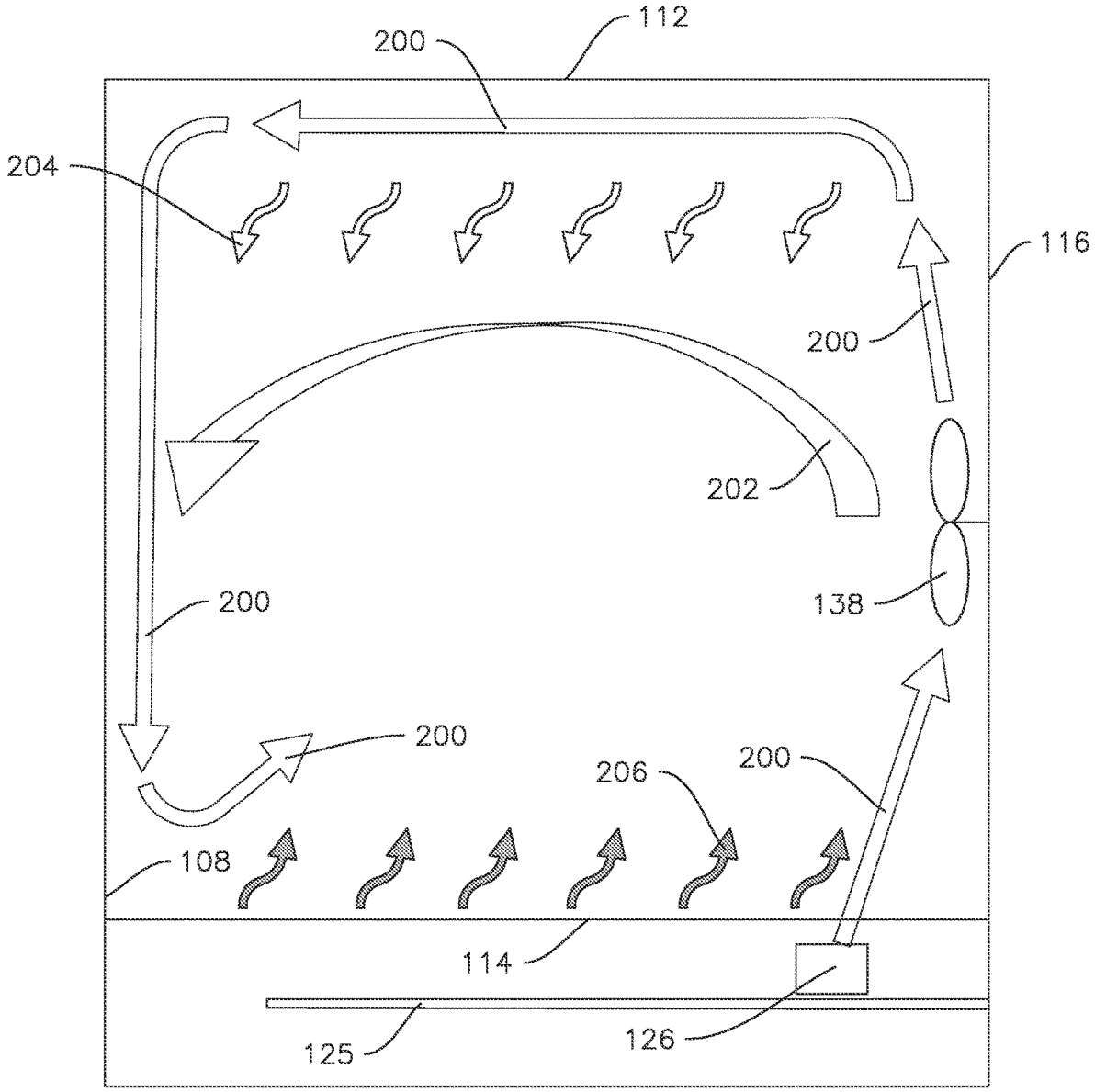
FIG. 7 provides a schematic view of flow paths for hot gases within the oven appliance of FIG. 4.

As shown in FIGS. 4 and 7, in some embodiments, the oven appliance 100 may also include bottom electric heating element 125. In such embodiments, where the second bottom heating element is an electric resistance heating element, the gas burner 126 is not the only heat source for the chamber, but may be the only combustive heat source for the chamber 104. In such embodiments, the bake operation may be similar to that described above with respect to FIGS. 2 and 5, with the additional, optional, activation of the bottom electric heating element 125. When the bottom electric heating element 125 is activated, the cooking chamber 104 may thereby receive radiant heating (e.g., as illustrated by shaded arrows 206 in FIG. 7), e.g., directly from the bottom electric heating element 125 and/or via the thermally conductive bottom wall 114 of the chamber 104.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven appliance, comprising:

a cabinet defining a vertical direction, a lateral direction, and a transverse direction, the vertical, lateral, and transverse directions being mutually perpendicular, the cabinet comprising a front portion spaced apart from a back portion along the transverse direction and a left side spaced apart from a right side along the lateral direction;

a chamber defined within the cabinet for receipt of food items for cooking;

a gas burner positioned below a bottom wall of the chamber;

an electric heating element positioned below the gas burner;

a natural convection flow path defined through the chamber, the natural convection flow path extending from an origin at the gas burner to a top wall of the chamber;

a convection fan positioned along the natural convection flow path above the gas burner and below the top wall, the convection fan positioned and configured to divert combustion products generated by the gas burner from the natural convection flow path along a forced convection flow path towards a center of the chamber when the convection fan is activated.

2. The oven appliance of claim 1, wherein the gas burner is the only combustive heat source for the chamber.

3. The oven appliance of claim 1, wherein the gas burner is positioned at a rear portion of the chamber.

4. The oven appliance of claim 1, wherein the natural convection flow path extends from the gas burner, upward along the vertical direction across a back wall of the chamber, and forward along the transverse direction across the top wall of the chamber.

5. The oven appliance of claim 1, wherein the gas burner extends along the lateral direction parallel to a back wall of the chamber.

6. The oven appliance of claim 1, wherein the gas burner is the only heat source for the chamber.

7. The oven appliance of claim 1, further comprising a convection heating element encircling around the convection fan.

8. The oven appliance of claim 1, further comprising a top heating element positioned between the top wall of the chamber and the convection fan.

9. An oven appliance, comprising:

a cabinet defining a vertical direction, a lateral direction, and a transverse direction, the vertical, lateral, and transverse directions being mutually perpendicular, the cabinet comprising a front portion spaced apart from a back portion along the transverse direction and a left side spaced apart from a right side along the lateral direction;

a chamber defined within the cabinet for receipt of food items for cooking;

a gas burner positioned below a bottom wall of the chamber and at a rear portion of the chamber;

an electric heating element positioned below the gas burner;

a natural convection flow path defined through the chamber, the natural convection flow path extending from an origin at the gas burner to a top wall of the chamber;

a convection fan positioned along the natural convection flow path above the gas burner and below the top wall, the convection fan positioned and configured to divert combustion products generated by the gas burner from the natural convection flow path along a forced convection flow path towards a center of the chamber when the convection fan is activated.

10. The oven appliance of claim 9, wherein the gas burner is the only combustive heat source for the chamber.

11. The oven appliance of claim 9, wherein the natural convection flow path extends from the gas burner, upward along the vertical direction across the back wall of the chamber, and forward along the transverse direction across the top wall of the chamber.

12. The oven appliance of claim 9, wherein the gas burner extends along the lateral direction parallel to the back wall of the chamber.

13. The oven appliance of claim 9, wherein the gas burner is the only heat source for the chamber.

14. The oven appliance of claim 9, further comprising a convection heating element encircling around the convection fan.

15. The oven appliance of claim 9, further comprising a top heating element positioned between the top wall of the chamber and the convection fan.

16. The oven appliance of claim 1, wherein the bottom wall includes a hood having an open end, wherein the open end partially defines the natural convection flow path, and wherein the open end is positioned and oriented such that the natural convection flow path extends back to the back wall and up towards the top wall.

17. The oven appliance of claim 9, wherein the bottom wall includes a hood having an open end, wherein the open end partially defines the natural convection flow path, and wherein the open end is positioned and oriented such that the natural convection flow path extends back to the back wall and up towards the top wall.

* * * * *